US007607987B2

(12) United States Patent
Alter

(10) Patent No.: US 7,607,987 B2
(45) Date of Patent: Oct. 27, 2009

(54) GOLF STANCE AND BALL ALIGNMENT GUIDE

(76) Inventor: Hobart L. Alter, P.O. Box 144, Deer Harbor, WA (US) 98243

( * ) Notice: Subject to any disclaimer, the term of this patent is extended or adjusted under 35 U.S.C. 154(b) by 23 days.

(21) Appl. No.: 11/939,199

(22) Filed: Nov. 13, 2007

(65) Prior Publication Data

US 2009/0124406 A1 May 14, 2009

(51) Int. Cl.
*A63B 69/36* (2006.01)

(52) U.S. Cl. ..... 473/218; 473/273

(58) Field of Classification Search ..... 473/218, 473/257, 261–273
See application file for complete search history.

(56) References Cited

U.S. PATENT DOCUMENTS 1,686,323 A * 10/1928 Von Der Heyde ..... 473/282
3,610,632 A * 10/1971 Caldwell ..... 473/272
4,257,608 A * 3/1981 Funk ..... 473/272
4,563,010 A 1/1986 McDorman et al.
4,583,739 A 4/1986 Kabbany
4,718,674 A * 1/1988 Henry ..... 473/218
5,013,044 A * 5/1991 Hesselbart ..... 473/218
5,303,926 A * 4/1994 Owens et al. ..... 473/261
5,362,060 A 11/1994 Hinson
5,482,284 A * 1/1996 Vandever ..... 473/218
5,588,653 A * 12/1996 Robinson ..... 473/218
5,827,128 A 10/1998 Finch et al.
5,944,613 A * 8/1999 Dubois ..... 473/218
6,726,576 B1 4/2004 Froggatte
7,048,642 B2 * 5/2006 Burley ..... 473/270

* cited by examiner

*Primary Examiner*—Nini Legesse
(74) *Attorney, Agent, or Firm*—Pedersen & Co., PLLC; Ken J. Pedersen; Barbara S. Pedersen

(57) ABSTRACT

A guide for improving a golfer's stance and swing includes an elongated hollow member, an elongated insert member, and a connector. In golf-practice configuration, the hollow member and the insert member cross each other at 90 degrees and are adjustable relative to each other for different ball placement. In a storage configuration, the insert member is removed from the connector and slid and latched into an interior space of the hollow member. The hollow member and the insert member are preferably tubular so that the storage configuration is generally a tube-within-a-tube. The preferred connector is near the intersection of the hollow member and the insert member but does not require any structure to be between the hollow member and the insert member at or near the place where they cross each other, resulting in a low profile guide. Preferably, only a small portion of the connector contacts the practice mat or ground, resulting in minimal resistance to movement on the mat or ground. Multiple, sharply-pointed pegs may temporarily fix the guide to a mat, and may be connected to the hollow member and/or the insert member for storage of the entire device as a single, compact unit.

26 Claims, 7 Drawing Sheets

GOLF STANCE AND BALL ALIGNMENT GUIDE

BACKGROUND OF THE INVENTION

1. Field of the Invention

The present invention relates to accessories for improvement of a golfer's game, especially by improving the golfer's stance and swing. The invented guide serves as a visual reference for placement of the golfer's feet relative to an imaginary target line and relative to the ball, and squaring of the face of the club to the ball.

2. Related Art

In addressing a golf ball before a swing, a golfer should stand with the toes of both feet on a line parallel to the plane of the desired path of the ball to a target. Therefore, to assist in aligning the user's feet, it is desirable to mark an imaginary target line on the ground, between the golfer's feet and the ball, that points to the target.

In the past, golfers have frequently laid a golf club on the ground as the marker for the imaginary target line. If the golfer stands with the toes of both feet on a line parallel to the marker golf club, and, hence, parallel to the imaginary target line, the toes are, for all practical purposes, also on a line parallel to the desired path of the ball.

Further, in addressing the ball, it is desirable to imagine and/or mark a line that is perpendicular to the target line and that intersects the ball. The golfer will further position his feet relative to this "ball line" so that it passes between the golfer's feet at a desired location that differs according to each golfer's preferences and the golf club chosen for the shot. For example, when using a driver, a golfer may position his feet so that the ball line passes near to the inner side of the forward heel (as described later regarding FIG. 1). Other preferences and other clubs may result in the golfer moving his feet relative to the ball line, for example, so that the ball line is generally mid-way between the feet.

The above guidelines for stance and ball placement typically result in the golfer's feet, hips, and shoulders being aligned in planes parallel to the desired path of the ball, increasing the chances of a "squarely-hit" ball. These results are understood in the field of golf to be desirable for an accurate golf shot.

Various inventors have taken a further step by providing a cross-shaped device that comprises two elongated members perpendicular to each other. Representative cross-shaped devices include: McDorman, et al. (U.S. Pat. No. 4,563,010, issued Jan. 7, 1986), Kabbany (U.S. Pat. No. 4,583,739, issued Apr. 22, 1986), Hinson (U.S. Pat. No. 5,362,060, issued Nov. 8, 1994), Finch (U.S. Pat. No. 5,827,128, issued Oct. 27, 1998), Dubois (U.S. Pat. No. 5,944,613, issued Aug. 31, 1999), and Froggatte (U.S. Pat. No. 6,726,576, issued Apr. 27, 2004). Generally, these devices work by providing a first marker along the imaginary target line, and a second marker, along a line perpendicular to the target line, that points at the ball. The first marker fulfills the role, discussed above, of lying on the imaginary target line to point at the target and to assist in the golfer taking a proper stance relative to the desired path of the ball. The second marker also assists in orienting the stance of the golfer so that the forward foot is just forward of said line intersecting the ball and so that the club face is likely to squarely hit the ball, as also discussed above.

The second marker is typically moveable relative to the first marker, so that the second marker may be moved to point at the ball. This way, the golfer may effectively use the device with many different ball positions in an area without moving the entire device. Typically, the second marker remains perpendicular to the first marker as it slides relative to the first marker to point at the ball.

Still, there is a need for an improved guide for the stance and swing of a golfer. The inventor believes there is a need for a guide that provides the desired visual references before, during and/or after the swing, without the guide being so large and bulky that it is distracting to the golfer. The inventor believes that there is a need for a device that may be easily used on grass or an artificial surface, and that is compact and easy to store and carry.

SUMMARY OF THE INVENTION

The present invention is a guide that may assist a golfer in assuming a proper stance relative to the ball and relative to the desired path of the ball and that may assist in improved squaring of the club face to the ball. The device is expected to enhance the golfer's swing because of these improvements in addressing the ball, but may also enhance the swing by providing continued visual reference/guidance during and/or after the swing.

The preferred guide device comprises two elongated members that are perpendicular to each other during use but that are preferably slid one inside the other during transport and storage. During use, the two elongated members are slidably received in an intersection member that defines where each elongated member crosses the other. By sliding the intersection member relative to one or both of the elongated members (and, likewise, by sliding one or both of the elongated members relative to the intersection member), the length of the "arms" of the cross-shaped guide may be changed in relative length, and the reference lines marked by the arms may be moved around on an area of the ground, mat or other surface where the golfer is practicing.

In preferred embodiments, the elongated members are tubular and are sized in diameter so that one fits inside the other for storage. The preferred intersection member comprises a perimeter wall without a bottom or top wall, wherein the perimeter wall has apertures through which the elongated members may be inserted and in which the elongated members slide for adjustment. A first set of apertures for a first of the elongated members is provided in two opposing sides of the perimeter wall and a second set of apertures is provided in the perimeter wall on opposing sides of the perimeter wall and 90 degrees to said first set of apertures. This way, the first elongated member may slide in the intersection member independently from the second elongated member.

Peg members may be provided with the device for pinning one of the elongated members to a practice mat. Whereas a golf tee will not be effective in holding down the preferred device on a practice mat, the pointed end of each preferred peg member is adapted to removably stick into the practice mat effectively and without damage to the mat. The peg members are adapted to attach to at least one of the elongated members, so that, when the elongated members are in storage configuration, the peg members are connected to, and easily carried along and stored with, the rest of the device with minimal or no chance or injury by the points of the peg members. Golf tees may be used to secure the device to the ground.

The preferred embodiments of the invented guide comprise entirely or substantially slender and light-weight components. The preferred tubular elongated members are small in diameter, compared for example, to the diameter of a golf ball, and are preferably substantially smooth along most of their outer surfaces. The intersection member is preferably simple and preferably has no moving parts and no connection means other than the elongated members sliding in apertures in its perimeter wall. As a result, the preferred embodiments are compact and lightweight, when in use or in storage. In use, the thin members extending out in a cross-shape from a small core have a delicate or minimalist appearance rather than a bulky, cumbersome, and/or distracting appearance. The golfer sees the device during addressing the ball and/or during the swing, but does not become distracted or frustrated by the idea of a bulky device being between his feet and between him and the ball. Further, the transition, from using the guide as a training/practice tool to exhibiting the same good stance and swing during regular play (wherein the guide typically will not be used), will be more effective and more natural. In other words, by using the slender and minimalist guide according to embodiments of the invention, stance and swing improvement is expected to be easier during training/practice and said improvement is expected to be more easily replicated during regular play. The preferred embodiments are further explained by the drawings and the Detailed Description.

BRIEF DESCRIPTION OF THE DRAWINGS

FIGS. 14, 15 and 16 illustrate an oval, a diamond-shaped, and a square intersection member, respectively.

DETAILED DESCRIPTION OF THE PREFERRED EMBODIMENTS

Referring to the Figures, there are shown two, but not the only, embodiments of the invented guide device for golfers. The preferred device comprises a marker assembly comprising two elongated markers that are laid on, and that indicate, two important lines. These lines comprise a first line that is (for all practical purposes) parallel to the desired line of travel of the golf ball B when accurately hit toward the target, and a second line perpendicular to the first line that extends through the ball. The importance of these two lines is described in the Related Art and Summary of the Invention sections of this document. For convenience, one of the elongated markers may be called a target-pointing marker and the other may be called a ball-pointing marker.

The preferred marker assembly further comprises a connector that serves to connect the markers in the preferred, perpendicular configuration during use. Preferably, the connector received both markers at or near the location wherein their cross/intersect each other and, hence, may be called an intersection member. The preferred intersection member is a ring that connects the two elongated markers during use and allows at least one, and preferably both, of the elongated markers to slide relative to the ring for adjustment of the location of the ball-pointing marker relative to the target-pointing marker. As will be discussed further below, this allows for the device to be used with balls in various locations within the general area of the device without pulling the device up from the mat/ground and relocating it.

Figure 1:
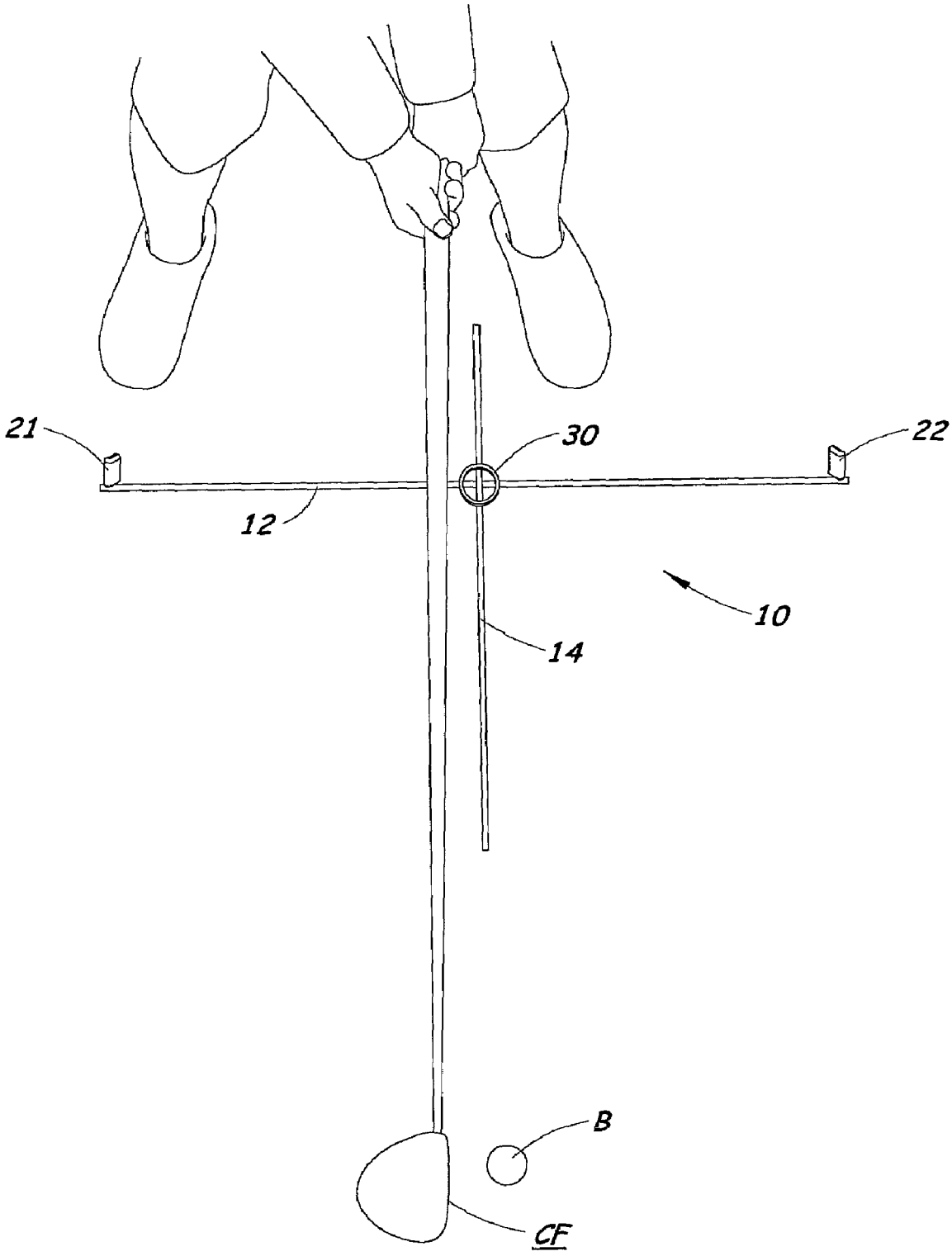
FIG. 1 is a top perspective view of one embodiment of the invented device in use by a golfer. The direction to the right in FIG. 1 is considered the "front" or "forward" in this Description; however, it will understood that the invention may be used for right or left-handed golfers and the invention is not limited to methods of use exactly as shown in FIG. 1.
Figure 2:
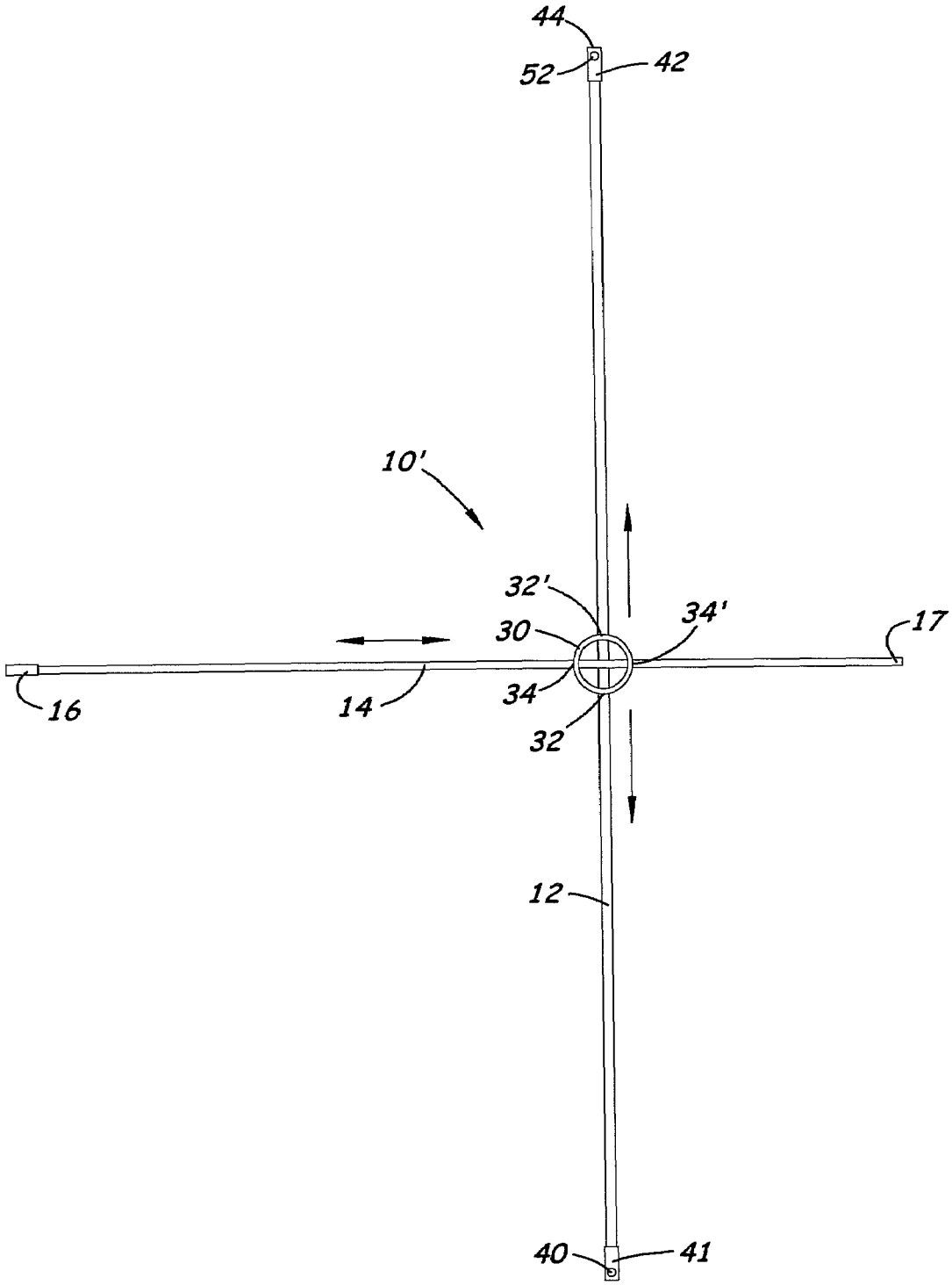
FIG. 2 is a top view of the embodiment of FIG. 1, with the pegs removed.
Figure 3:
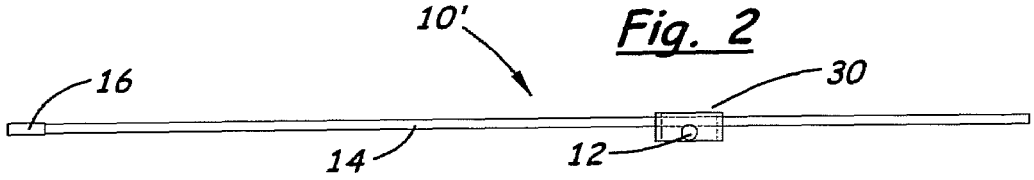
FIG. 3 is an end view of the embodiment of FIGS. 1 and 2, again with the pegs removed.
Figure 4:
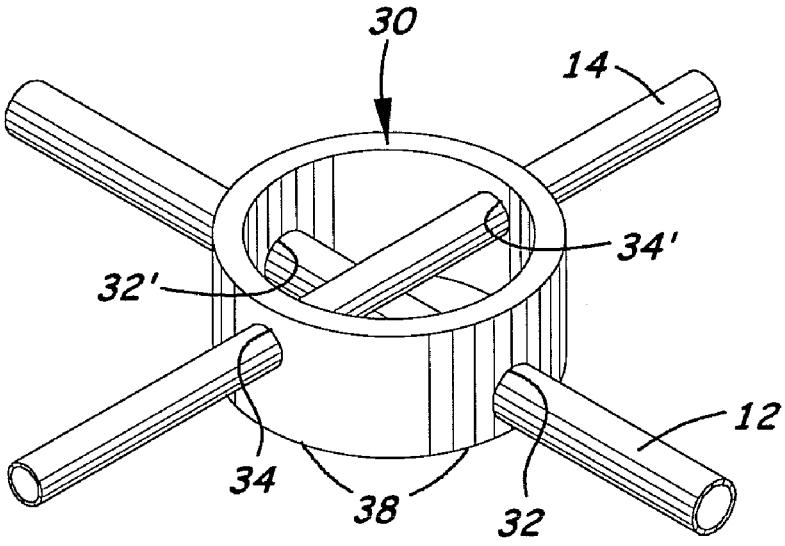
FIG. 4 is a partial top perspective view of the intersection ring of the embodiment of FIGS. 1-3, with the preferred two tubes extending through pairs of apertures that reside in the ring wall 90 degrees from each other.

Referring specifically to FIGS. 1-12, there is shown one embodiment of the invented device 10. In FIG. 1, the device 10 is in use by a golfer, placed similarly to prior art cross-shaped guides, but preferably farther back from the ball, for example, 8-16 inches from the ball. This placement, the thinness of the two elongated markers (tubes 12, 14) and the small size and simplicity of the intersection member (ring 30), allow the device 10 to form an effective reference "grid" of two perpendicular members that is visible in the general vicinity of the golfer's feet and the ball but without distracting the golfer by taking up a major portion of the view of the golfer. Using the preferred embodiment is more like standing over two thin lines on the mat/ground than standing over a bulky, cumbersome apparatus. The same thinness and small size and simplicity of the ring, combined with preferred latching and storage features, results in a compact and safe package that may be easily inserted into a golf bag or otherwise carried without taking up much volume or adding much weight.

The preferred marker assembly 10' (the device 10 minus the pegs) comprises two elongated markers that are a first tube 12 and a second, relatively-smaller-diameter tube 14. See FIGS. 2-4. Preferably, both tubes have cylindrical tube walls that are solid and uncut all around the circumference of the tubes, preferably along substantially the entire length of the tubes. End-caps may be added (for example, see 16, 41, and 42 in FIG. 2, 7-9) as one way to add threading, latch slots, or other structure.

Tube 12 is entirely or substantially hollow, so that tube 14 may be received therein for storage. The outer diameter of tube 14 should be smaller than the inner diameter of tube 12, preferably along substantially all of the length of the tubes 12, 14, so that tube 14 may be substantially contained within and generally coaxial with tube 12 during storage. By "substantially contained within," it is meant that preferably at least 70 percent (and more preferably at least 80 percent) of the length of the second tube 14 (including the length of any end caps or attachments) may be contained within the hollow interior space of tube 12. Tube 14 is preferably entirely or substantially hollow, in order to reduce the overall weight of the device 10, but may alternatively be solid and/or non-cylindrical/non-tubular. End-caps, or other attachments, on tube 14 may be solid or hollow as needed, but typically the only end-cap or attachment on tube 14 will be the preferred internally-threaded end 16 and the preferred latch post 46.

Tubes 12 and tube 14 are slidably received in apertures 32, 32' and 34, 34', respectively, in a ring 30. The fit between each tube and its respective apertures is a slip-fit wherein each tube has an outer diameter of only about 1-5 (preferably 1-3) thousandths of an inch less than the diameter of its respective apertures; this way, the tubes slid easily through the apertures but do not wobble in the apertures.

Apertures 32, 32' are located in a lower region of the ring wall, so that tube 12 passes through said apertures 32, 32; to be near the lower edge 38 of the ring. Apertures 34, 34' are located in an upper region of the ring wall, so that tube 14 passes through said apertures 34, 34' above apertures 32, 32' and above tube 12. Tube 12 rests in a plane that is above and preferably parallel to the plane in which tube 14 resides. This is shown to best advantage in FIGS. 3 and 4. Although the apertures and the tubes are three dimensional, it will be understood that each tube and its apertures may be said to be on a horizontal plane, and that the horizontal plane of tube 12 and its apertures 32, 32' are on a horizontal plane lower than the horizontal plane of tube 14 and its apertures 34, 34'.

In use on the ground or a mat or other surface upon which the golfer is practicing or playing, the device rests with the bottom tube 12 and the bottom edge 38 of the ring 30 on the ground/mat/surface. The lower tube 12 is preferably pegged to the surface upon which it rests, using two pegs 21, 22 (preferred for mats) or two golf tees (preferred for grass/ground). The pegs 21, 22 are preferably provided with the device 10, and are adapted to be easily insertable into a mat. This is an advantage over conventional devices that use only golf tees to pin down the guide, as golf tees may not be effectively used to pin a guide to a mat. The pegs 21, 22 each have a main body 24, 25 and a pointed shaft 28, 29 extending out from the main body. Each shaft 28, 29 is preferably offset from the centerline of its respective main body 24, 25 for reasons that will be discussed below.

Figure 5:
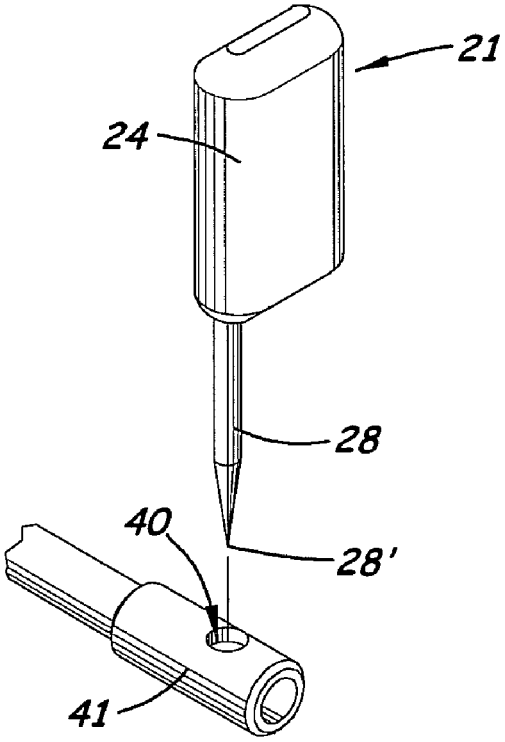
FIGS. 5 and 6 are perspective views of one of the pegs of the embodiment of FIG. 1 being inserted through an end of the larger-diameter tube of the preferred embodiment for securement to a mat. Typically, golf tees may be used in place of the pegs for securement of the device to grass or ground.
Figure 6:
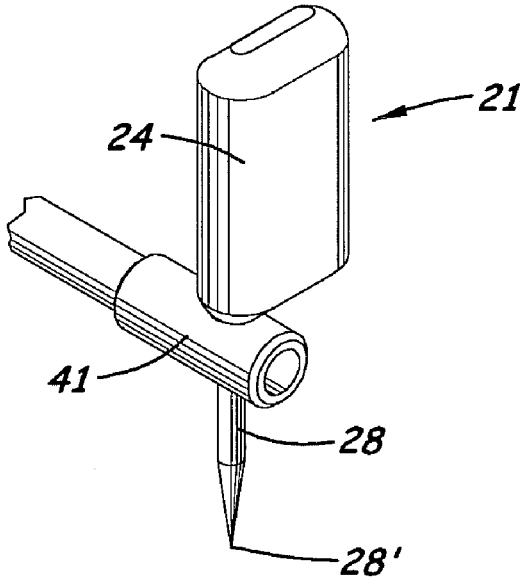

FIGS. 5 and 6 illustrate the shaft 28 of one of the pegs 21 being inserted through a transverse bore 40 through an end 41 of the tube 12. The sharply-pointed tip 28' of the shaft 28 allows the peg to be pushed into mats and other artificial materials. Such a bore or other receiving aperture is provided in both ends 41, 42 of tube 12, so that both ends of the tube 12 may be removably fixed, on the imaginary target line, to the mat (preferably by provided pegs) or to grass/ground (preferably by golf tees).

Ring 30 and tube 14 are preferably connected to tube 12 at the time tube 12 is pinned to the mat/ground. Ring 30 and tube 14 may then be slide along tube 12 until tube 14 points at the ball. Preferably after this step, but alternatively prior to this step, tube 14 may be slid relative to the ring to reach closer to or to be farther from the ball, as desired by the golfer. As discussed above, many golfers will choose to move tube 14 farther away from the ball as long as it is still in view of the golfer. This will allow the golfer to use tube 14 as a reference while not distracting the golfer by placing the tube 14 close to the ball or close to the region wherein the club will rest and then travel.

To adjust tube 14 to point at the ball, the golfer may grasp, push, pull, and/or tap the ring 30 and/or the tube 14 to slide both ring 30 and tube 14 along the length of the secured tube 12. To adjust tube 14 closer to or farther away from the ball, the golfer may grasp, push, pull, and/or tap tube 14 and pull or push it so that it slides in apertures 34, 34' to the desired location.

Once tube 12 is fixed to the mat/ground on the imaginary target line, and tube 14 is adjusted as described above, the golfer may take his stance near the device 10. As described earlier in this document and generally as shown in FIG. 1, his feet will straddle tube 14 and the toes of both feet will preferably line up slightly distanced from (preferably 4-10 inches) but parallel to tube 12. Also as discussed earlier, the golfer may stand with tube 14 in various positions between the feet, that is, nearer to one foot or the other or in the middle, depending upon preference and the chosen club. FIG. 1 illustrates the golfer standing so that his forward foot is near the rear end of tube 14, but other positions may be desirable. Using tube 14 as a visual reference, the golfer will address the ball with the club face CF squared against the ball (so that the club face is perpendicular to the imaginary target line when the club impacts the ball), and, during the swing, preferably will continue to use the device 10 as a visual reference for the proper orientation of the club face and the proper direction and proper plane of the swing, including of the follow-through.

When many balls are sequentially hit from the same spot on the mat/ground, the above stance and procedure may be used without adjustment of the device 10. In the event that the ball location is changed during the practice session, because of divots or other factors, for example, tube 14 may be adjusted to accommodate said ball location change. Adjustment of tube 14 along the length of tube 12, or adjusting tube 14 toward or away from the ball, may be done easily, for example, by tapping tube 14 with a golf club. Such adjustments may be made, therefore, without the golfer having to bend over and without the golfer having to manipulate complex mechanisms. Alternatively, but less preferably, the golfer may adjust tube 14 along the length of tube 12 by tapping the ring 30. In the event that ball location is changed more than may be accommodated by adjustment of tube 14, the golfer may easily move and re-secure the entire device 10 to another location on the mat/ground. Moving the entire device may be done easily, because of the light weight of the device, by briefly bending over to un-pin tube 12, tapping the device 10 with a golf club, and then briefly bending over again to re-pin tube 12, for example.

To store the device 10, the user (such as the golfer, caddy, or instructor) may un-pin the device from the ground or mat and slide tube 14 entirely out of the ring 30 by sliding it to the left in FIG. 1. One end 17 of tube 14 is preferably uncapped and un-enlarged, so that it remains the diameter of the major portion of the tube 14, and, hence, may easily slide out of the ring. That same end 17 is inserted into an opening 44 in end 42 of tube 12 and tube 14 is slid into the hollow interior of tube 12 substantially all the way to the opposing end 41 of tube 12.

Figure 7:
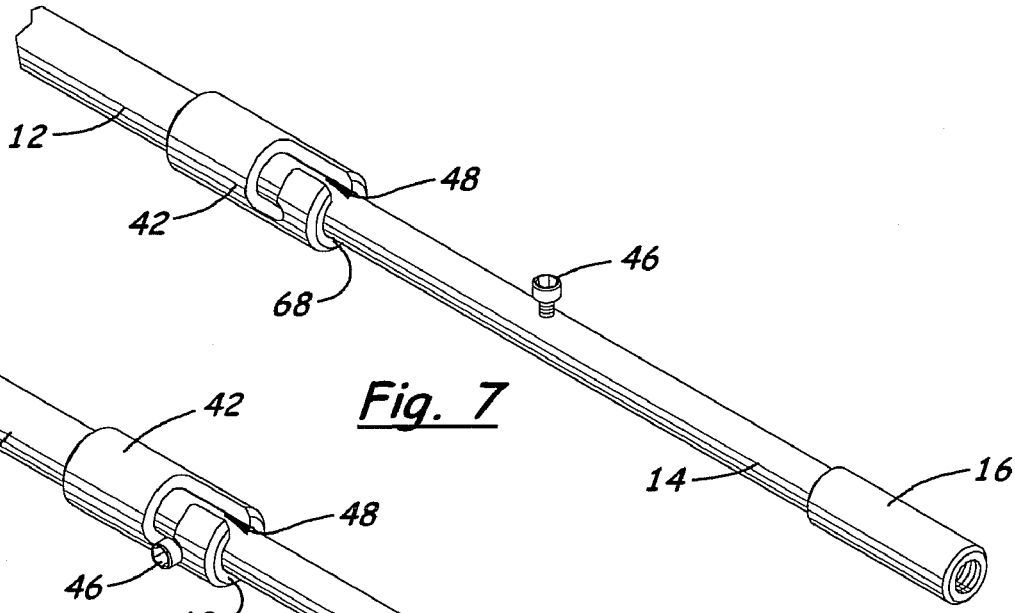
FIGS. 7 and 8 are perspective views of the latching ends of the two tubes of the device of FIGS. 1-4, illustrating the inner tube being inserted into the outer tube (FIG. 7) and the inner tube rotated relative to the outer tube to latch the two tubes together for storage (FIG. 8).
Figure 8:
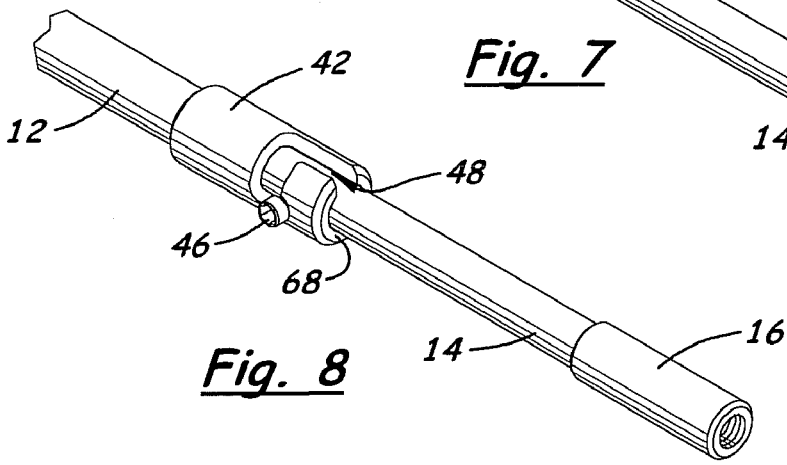
Figure 9:
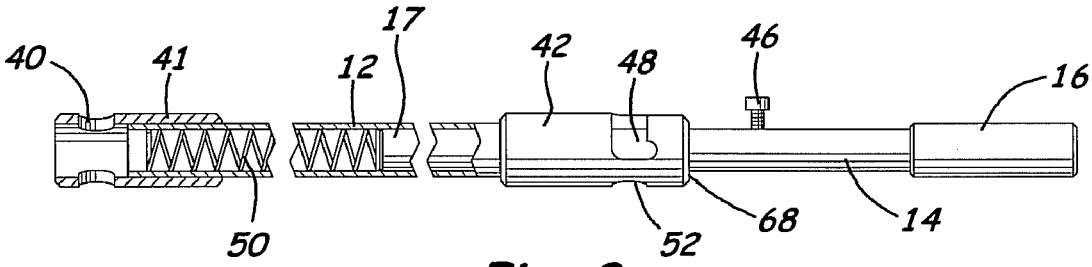
FIG. 9 is a partial, detail view of the operation illustrated by FIGS. 7 and 8, wherein the opposing ends of the inner and outer tubes are also illustrated. The device is being moved into storage configuration by inserting the smaller-diameter tube through an open end of the larger-diameter tube. In this view, the inner (smaller-diameter) tube is abutting against and beginning to compress a spring within the opposing end of the outer (larger diameter) tube, so that, upon latching the inner tube into the outer tube via a post and slot system (as in FIG. 8), the inner tube will be biased to remain latched until a user purposely unlatches the two tubes.

As illustrated to best advantage in FIGS. 7 and 8, tube 14 comprises a post 46 that may be received in hook slot 48 of tube 12 for latching tube 14 to tube 12. As best shown in FIG. 9, a spring 50 or other bias system is provided to urge the latch (formed in this embodiment by post 46 and slot 48) to stay in the latched position. Compression spring 50 is provided at the opposing end 41 of tube 12, so that, when tube 14 is substantially entirely contained within tube 12, tube end 17 impacts the spring 50 or a spring plate, and, upon further forcing of tube 14 into tube 12 compresses spring 50 to create the bias that works to keep the tubes 12, 14 latched together. As will be clear from the drawings, after sliding tube 14 into tube 12 and guiding the post 46 into the axial portion of slot 48, rotating tube 14 relative to tube 12 while applying continued force against the bias of the spring 50 will move the post 46 to enter the radial portion of the slot 48. Releasing tube 14 will allow the spring bias to "hook" the post 46 in the slot 48 until purposely unlatched by a user.

The axial portion of the slot 48 may serve as an aperture through one side of the tube wall of tube 12. By cooperating with an opposite aperture 52 (visible in FIGS. 2 and 9) forms the bore through which the shaft 29 of peg 22 extends to secure end 42 of tube 12 to the mat (or through which the shaft of a golf tee extends to secure end 42 to the grass/ground).

Figure 10:
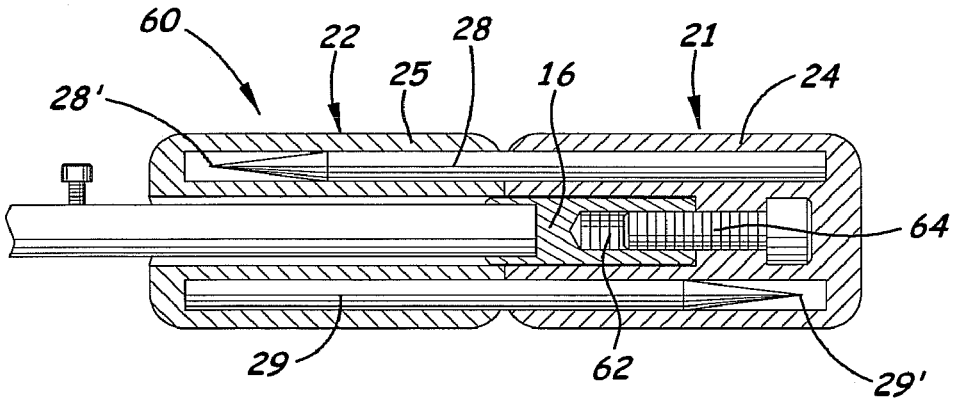
FIG. 10 is a partial, side cross-sectional view of a peg assembly attached to the tube assembly for storage, wherein the sharp prong of each peg is received and shielded by the other peg body and the inner tube is threadably connected to the distal peg in order to hold the entire peg assembly on the inner tube.
Figure 11:
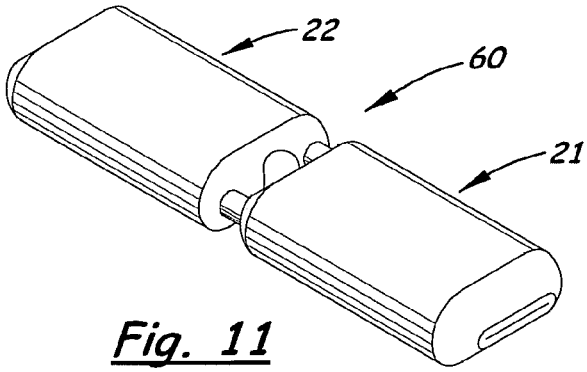
FIG. 11 is a perspective view of the peg assembly of FIG. 10, removed from the inner tube.
Figure 12:
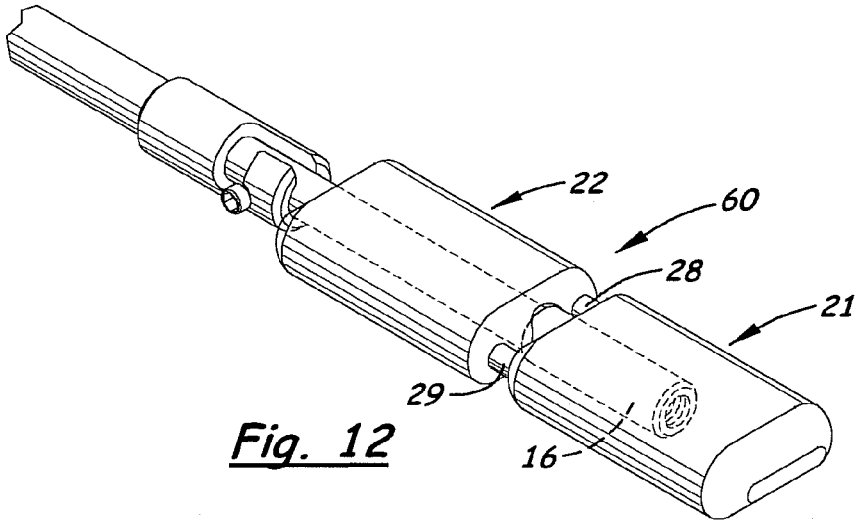
FIG. 12 is a partial, perspective view of the latching end of the two tubes, wherein the inner tube has been latched to the outer tube and the inner tube has been inserted into the two-peg assembly of FIG. 11 (see also FIG. 10). The dashed lines in this figure portray the end of the inner tube as it resides inside the peg assembly. The threaded member that is screwed into the inner tube to connect the peg assembly to the tube is not shown in this figure, however.

FIGS. 10-12 illustrate a peg assembly 60 that is formed by connecting the two pegs 21, 22 together, generally end-to-end, and that is connected to the tube-within-a-tube storage configuration of marker assembly 10' so that the peg assembly 60 is preferably generally coaxial with the stored tubes 12, 14. While the preferred peg assembly 60 is adapted to attach to tube 14 during storage, alternative embodiments may attach a peg assembly or the individual pegs to tube 12 or to both tube 12 and tube 14. In the preferred embodiment, each shaft 28, 29 is inserted into the main body 25, 24 of the other peg, so that the points 28', 29' of the shafts are not exposed and so that the peg assembly 60 may be connected as a single unit to one or both of the tubes. Preferably, as shown in FIG. 10, the peg assembly 60 is connected to the end 16 of tube 14 that protrudes beyond tube 12 when the tubes 12, 14 are latched in storage configuration. This may be done by providing internal threads 62 on end 16 of the tube 14, so that the end 16 may threadably engage a threaded post 64 inside one of the pegs 21. A threaded connection provides sure and reliable connection of the peg assembly to the tube(s), so that it is unlikely that the peg assembly or either peg will fall off and become a danger. Alternatively, but less preferably, there may be other connection methods, such as a snap fit, friction fit, cotter- or other pin-type retainer, or even a strap or tie, that will retain the peg assembly on the tube assembly so that the pegs are not lost and the shafts are not exposed. Alternatively, one or both pegs may be provided with connector(s), latch(es), or lock(s), that retain the two pegs together in a peg assembly, with the shaft points covered, even when the pegs are not connected to either of the tubes 12, 14 or to any other portion of the device. The peg assembly may be carried or stored separately from the tubes of the device, for example, in a pouch of a golf bag.

To provide a fairly tight fit of the peg assembly 60 on the tube 14, an internally-threaded end-piece (shown to best advantage in FIGS. 2, 7, and 8) is provided on the tube 14 to form end 16 and it is this member that screws onto the post 64. This way, tube 14 extends all the way through the main body of one of the pegs 22 to reach and secure to the post 64 in the main body 24 of the other peg 21. With peg 22 thus captured on tube 14 between the end extremity 68 of tube 12 and the other peg 21, peg 22 may slide a short distance on tube 14 but will not come off and will not expose the points 28', 29' of the shafts. The peg assembly 60 may be installed on tube 14 prior to, or after, latching of tubes 12, 14 together. The thread direction of the end 16 and the post 64 may be chosen to cooperate favorably with the direction of rotation required for latching of the tubes 12, 14. This way, screwing the peg assembly 60 onto tube 14 will be less likely to unlatch the tubes 12, 14, and/or latching the tubes 12, 14 will be less likely to unscrew the peg assembly 60 from tube 14. Alternatively, and especially if the bias from spring 50 is strong, the thread direction of end 16 and post 64 relative to the latching direction may not matter.

Figure 13A:
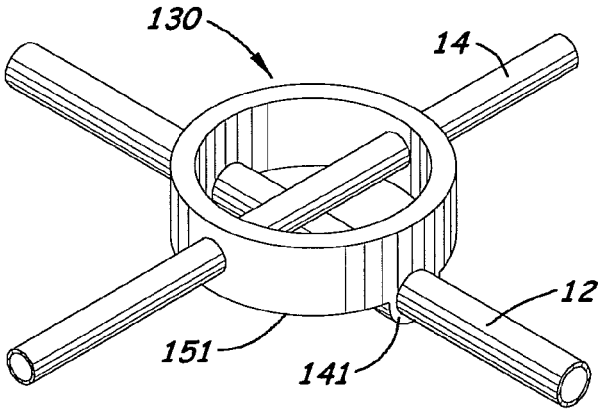
FIG. 13A is a partial, detail, perspective view of an alternative intersection ring being used with the tubes of the embodiment of FIGS. 1-12, wherein a significant portion of the lower perimeter edge of the ring is recessed relative to the regions through which a tube extends.
Figure 13B:
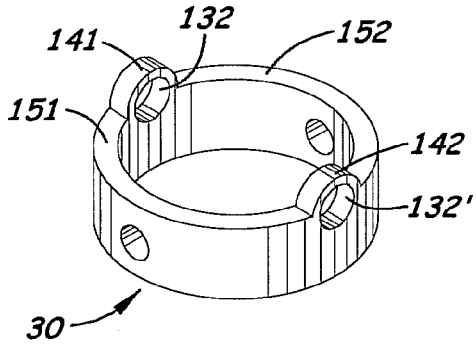
FIG. 13B is a bottom perspective view of the intersection ring of FIG. 13A, which shows the recessed perimeter edge to best advantage.

FIGS. 13A and 13B illustrate an alternative, especially-preferred intersection ring 130 for use with the tubes 12, 14 and pegs 21, 22. This ring 130 features an uneven bottom perimeter edge, preferably having two members ("ears") 141, 142 that protrude down from the surrounding regions of the perimeter edge to surround and define apertures 132, 132' and to provide two points on which the ring 130 rests on the mat/ground. This perimeter edge structure may instead be described as comprising edge portions 151, 152 that are recessed relative to the edge portions at ears 141, 142. Preferably, edge portions 151, 152 are recessed to an extent that they are on or above (in FIG. 13A and when on the mat/ground) the horizontal plane that extends through the center axis of tube 12. In other words, the preferred ears 141, 142 extend below recessed portions 151, 152 a distance equal to about ½-⅔ of the diameter of the tube 12. Other amounts may be effective, but it is preferred that the ears 141, 142, do not extend so far below portions 151, 152 that the device will tend to wobble or "teeter-totter" with the ring and/or tube 12 as a fulcrum.

The ear and recess structure of the bottom perimeter edge results in a smaller amount of the ring 130, compared to ring 30, resting on the mat/ground during use, and, especially, smaller portions dragging along the mat/ground when the user wishes to move the device or a portion of the device along the mat/ground to a new location. Further, the ear and recess structure results in only a small amount of the ring 130 being lower than the tube 12; the curved wall of each ear is only a fraction of an inch thick (preferably about ⅛-¼ inch), so that each ear protrudes only a fraction of an inch (preferably about ⅛-¼ inch) from the surface of the tube 12 held in the respective aperture 132, 142'. The ears themselves, therefore, offer little resistance to movement of the ring 130 along the mat/ground. When the golfer taps tube 14 and/or ring 130 to adjust the position of tube 14 along the length of tube 12, ring 130, and especially it ears 141, 142, move along the mat/ground easily, providing little resistance to the tube 14/ring 130 combination sliding along tube 12. Further, when the golfer wishes to move the entire device, the ring 130, and especially its ears 141, 142, provide little resistance and the device may be tapped or otherwise moved easily along the mat/ground. It may also be noted that ring 130 takes up less volume during storage and also reduces the total weight of the device 100.

The preferred intersection members, including rings 30, 130 or other members, are preferably open shapes, which are formed by a sidewall(s) that is/are spaced from the point at which tubes 12, 14 cross each other, and which have no top wall and no bottom wall. These features result in a light-weight member that slidably connects the tubes 11, 14 during use without structure/apparatus between the tubes at or near the point of crossing. One may note that, in the preferred embodiments, there is no structure at or near the center of rings 30, 130 except the tubes themselves and that there is no structure/apparatus on either of the tubes 12, 14 at any point along the portion of the tubes 12, 14 that is inside the ring 30, 130. This allows the tubes 12, 14 to be very close to each other where they cross (for example, 1-5 or more preferably 1-3 thousandths of an inch apart, as close as possible without rubbing), thus, providing a very low profile device. The open structure of the preferred intersection member further allows the user to view the tubes 12, 14 as tube 14 is being inserted through the intersection member.

Figure 14:
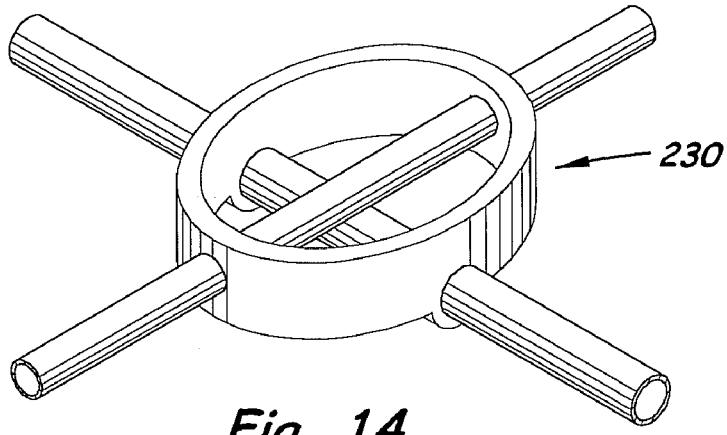
FIGS. 14-16 are alternative intersection members that may hold tubes in a cross-shaped configuration.
Figure 15:
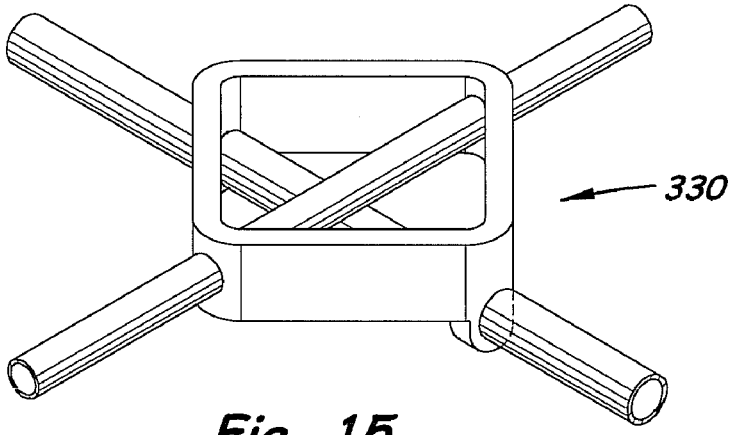
Figure 16:
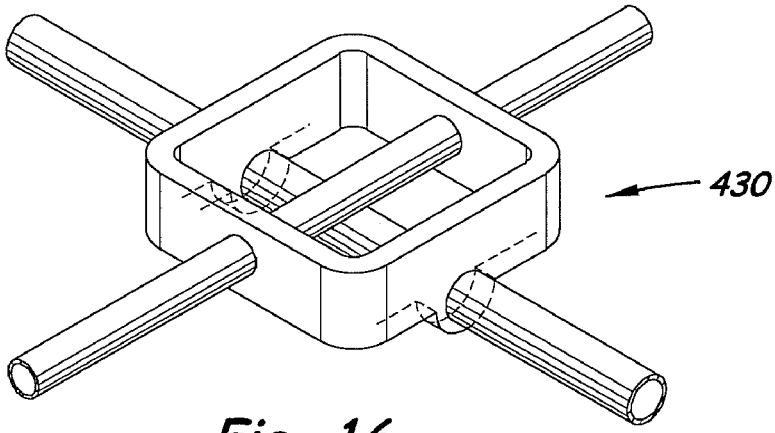

FIGS. 14-16 illustrate alternative intersection members that may be used with tubes 12, 14 and pegs 21, 22. An oval member 230, a diamond-shaped member 330, and a square member 430 are examples of non-circular, non-cylindrical shapes that may be effective. As with rings 30, 130, these members have no top or bottom wall, and are formed by one or more sidewalls that are spaced from the place where the tubes cross each other. As with rings 30, 130, there is preferably no apparatus/structure between the tubes in the space inside said sidewall(s), and the tubes reside in the intersection member with their closest surfaces (the bottommost portion of the top tube and the topmost portion of the bottom tube) being as close as possible without rubbing, which typically means that they are only a few thousandths of an inch apart at the point of crossing.

Alternatively, but less preferably, other shapes of intersection members may be used, including other frames or brackets, or solid members (for example, blocks with bores as apertures). Lower perimeter edge shapes and contours may be used other than those shown in the drawings. Simple, light-weight members are preferred, and it is preferred that the members have lower surfaces/edges that minimize resistance to sliding on the mat or ground. To accomplish this minimization of resistance, it is preferred to minimize the amount of the intersection member that contacts the mat/ground, which may be accomplished by minimizing the amount of the intersection member that extends to or below the horizontal plane in which the lower tube resides.

Figure 17:
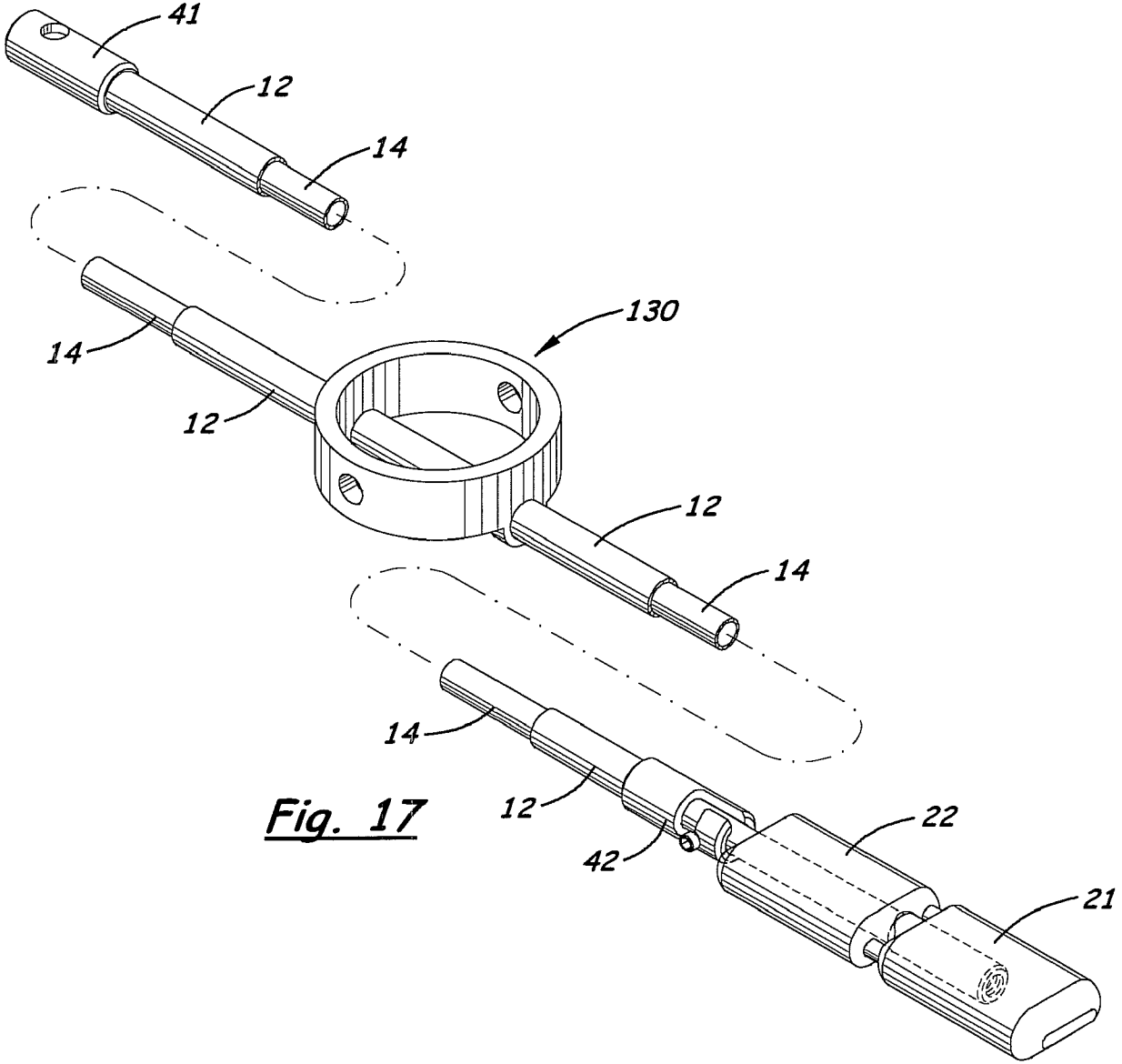
FIG. 17 is a perspective view of the preferred embodiment of the invention, in storage configuration, wherein, due to the length of the device, the ends and the middle of the device are cut apart for the purpose of illustration and wherein portions of the outer tube are cut away to reveal the inner tube.

In storage configuration, the device 10 of FIGS. 1-12 and the device 100 of FIG. 17 (which uses ring 130) each will be a thin elongated unit, with the ring 30, 130 attached to the outside of the outer tube (tube 12) and the peg assembly 60 secured to the end of the unit. The tubes and the entire device are preferably 2.5-4 feet long and the ring 130 is preferably about 1.5-2 inches in diameter. The device 10, 100 as a whole is then easy to carry and to store in a small space, for example, a small portion of a golf bag. Most preferably, the tubes and the entire device have a length in the range of 32-36 inches, so that, when the device is stored generally parallel to the golf clubs in the bag, an end of the device is visible and reachable at or slightly above the top rim of a golf bag (but preferably not so high above the rim that it interferes with club selection). The device 10, 100 may be easily pulled out of the golf bag; the simple tube and ring structure of the device is unlikely to hang up or catch on the golf bag or its contents. See FIG. 17 for an illustration of device 100 in storage configuration and ready for insertion into a golf bag or other transport means. Other than the especially-preferred ring 130, device 100 is the same as device 10 of FIGS. 1-12. In FIG. 17, portions of the outer tube 12 are cut away from the inner tube 14 in several places to show the tube-within-tube storage configuration along substantially all the length of the tubes 12, 14.

The preferred embodiments do not have moving parts (except for the sliding of intersection member and tubes relative to each other), do not have connected parts that fold or pivot relative to each other. Each of tubes 12, 14 may slide on its axis relative to the intersection member and may rotate on its axis in the apertures of the intersection member. Each tube 12, 14 preferably passes all the way through the intersection ring as one piece, that is, without joints, connections, pivots, or fasteners on the tubes in the vicinity of the intersection member. The preferred embodiments do not have wing-nuts, nuts/bolts, or other fasteners that must be loosened to move the tubes relative to each other or relative to the intersection member. The preferred embodiments do not include any ruler or measurement indicia. The preferred embodiments do not have any protrusions that extend upward from the tubes (except that the pegs or tees that fix tube 12 to the mat/ground may be said to protrude up above the ends of tube 12), and do not have any holder for the golf ball or any member that contacts the golf ball. The preferred intersection member is easily disconnectable from one of the tubes (tube 14) as discussed above. The preferred intersection member is typically kept from falling off of the other tube (tube 12) by means of end caps on each end of tube 12, but said end-caps may be adapted to be easily removeable from tube 12 if desired, so that the intersection member may be slid off of tube 12 when desired.

The simplicity and compactness of the preferred embodiments is especially desirable. Some embodiment of the device, therefore, may be described as consisting essentially of, or even consisting of: a first tube for placement on an imaginary target line near a golfer's feet; a second tube for pointing at a golf ball on the mat or ground; an intersection member holding said first and second tubes perpendicular to each other in a golf-practice configuration so that the first tube and second tube cross each other at a location inside the intersection member, and preferably but not necessarily, a plurality of sharply-pointed pegs that pin the first tube to a mat in the golf-practice configuration. Also, some embodiments of the invented device may be described as a golf practice guide that has a golf-practice configuration and a storage configuration, the guide comprising an elongated hollow member, an elongated insert member, and a connector; wherein, in the golf-practice configuration, the connector receives both the hollow member and the insert member at 90 degrees to each other and so that the hollow member and insert member are moveable relative to each other while remaining at 90 degrees to each other; and wherein, in the storage configuration, the insert member is removed from the connector and slid and latched into an interior space of the hollow member. In preferred embodiments, the location at which the markers (such as the tubes/hollow members/insert members discussed herein) cross each other is unencumbered by apparatus between and/or around the markers; preferably, there is no apparatus between the markers within at least 1.5 inches of the point at which the markers cross.

Although this invention has been described above with reference to particular means, materials and embodiments, it is to be understood that the invention is not limited to these disclosed particulars, but extends instead to all equivalents within the broad scope of the following claims.

I claim:

1. A golf stance guide for placement on a mat or ground, the guide comprising:

an elongated first marker for placement on an imaginary target line near a golfer's feet;

an elongated second marker for pointing at a golf ball on the mat or ground;

an intersection member holding said first and second markers perpendicular to each other in a golf-practice configuration;

wherein said first marker is hollow and has an interior space, said second marker is removable from the intersection member and slidable into the interior space to be generally coaxial with and contained substantially inside the first marker for storage;

wherein said intersection member comprises a top, a bottom, and a sidewall surrounding and defining an interior bore through said intersection member from said top to said bottom so that said top and bottom of said intersection member are open, the sidewall having a first set of apertures that slidably receive the first marker, and having a second set of apertures, 90 degrees to said first set, that slidably receive the second marker, so that, in said golf-practice configuration, said first marker and said second marker pass through said first set of apertures and said second set of apertures, respectively, and cross at 90 degrees to each other in said interior bore so that both said first marker and said second marker are visible where they cross from above and below the golf stance guide.

2. The guide as in claim 1, wherein said first marker and second marker are both tubular.

3. The guide as in claim 1, wherein said intersection member is selected from a group consisting of a ring, a square-shaped member, an oval-shaped member, and a diamond-shaped member.

4. The guide as in claim 1, wherein, in said golf-practice configuration, said first set of apertures are on a first horizontal plane, so that said first marker extends along said first horizontal plane, and said second set of apertures are on a second horizontal plane that is above said first horizontal plane, so that said second marker extends along said second horizontal plane.

5. The guide as in claim 4, wherein the intersection member sidewall has a bottom perimeter edge that comprises recessed portions that are on or above said first horizontal plane along which the first marker extends and wherein the bottom perimeter edge further comprises ear portions that protrude down from the sidewall to be lower than said recessed portions, the ear portions being for contacting the ground or mat in the golf-practice configuration to reduce contact of the intersection member with the mat or ground.

6. A golf stance guide for placement on a mat or ground, the guide comprising:

an elongated first marker for placement on an imaginary target line near a golfer's feet;

an elongated second marker for pointing at a golf ball on the mat or ground;

an intersection member holding said first and second markers perpendicular to each other in a golf-practice configuration;

wherein said first marker is hollow and has an interior space, said second marker is removable from the intersection member and slidable into the interior space to be generally coaxial with and contained substantially inside the first marker for storage;

wherein said intersection member comprises a sidewall having a first set of apertures that slidably receive the first marker, and having a second set of apertures, 90 degrees to said first set, that slidably receive the second marker;

wherein said first marker and said second marker pass through said intersection member and cross at 90 degrees to each other, and wherein the guide and the intersection member comprise no apparatus between the first marker and the second marker where the first and second markers cross.

7. The guide as in claim 6, wherein said first marker and said second marker are 1-3 thousandths of an inch apart where they cross.

8. The guide as in claim 6, further comprising a latch that retains the second marker in the first marker during storage.

9. The guide as in claim 6, further comprising a plurality of pegs, each having a shaft with a sharp point and each peg being adapted to pin the first marker to a mat, wherein said plurality of pegs are adapted to attach to one of said first marker and said second marker for storage.

10. A guide as in claim 6 wherein the intersection member is selected from a group consisting of a ring, a square-shaped member, an oval-shaped member, and a diamond-shaped member.

11. A guide as in claim 6, wherein the intersection member is a ring having a bottom perimeter edge that comprises recessed portions that are on or above a horizontal plane in which said first tube lies, for reducing contact of the ring with the mat.

12. A golf stance guide for placement on a mat or ground, the guide comprising:

an elongated first marker for placement on an imaginary target line near a golfer's feet;

an elongated second marker for pointing at a golf ball on the mat or ground;

an intersection member holding said first and second markers perpendicular to each other in a golf-practice configuration;

wherein said first marker is hollow and has an interior space, said second marker is removable from the intersection member and slidable into the interior space to be generally coaxial with and contained substantially inside the first marker for storage;

the guide further comprising a plurality of pegs, each having a shaft with a sharp point and each peg being adapted to pin the first marker to a mat, wherein said plurality of pegs are adapted to attach to one of said first marker and said second marker for storage;

wherein said plurality of pegs comprises a first peg having a first main body and a first shaft, and a second peg having a second main body and a second shaft, wherein, during storage, the first shaft extends into a bore in the second main body and the second shaft extends into a bore in the first main body for shielding the sharp point of the shafts and for connecting the first peg and the second peg in a peg assembly.

13. The guide as in claim 12, wherein said peg assembly is connected to an end of the second marker during storage.

14. The guide as in claim 13, wherein said peg assembly is connected to the end of the second marker by said end of the second marker extending through the second main body and threadably connecting to a threaded post inside the first main body so that the first and second pegs are held end-to-end and generally coaxial with the second marker.

15. A guide stance guide for placement on a mat, the guide consisting essentially of:

a first tube for placement on an imaginary target line near a golfer's feet;

a second tube for pointing at a golf ball on the mat;

an intersection member holding said first and second tubes perpendicular to each other in a golf-practice configuration so that the first tube and second tube cross each other at a location inside the intersection member, wherein the intersection member is slidable on the first tube for moving said location along the length of the first tube, and wherein the second tube is slidable relative to the intersection member for sliding the second tube closer to, and farther away, from the golf ball;

wherein the second tube is removable from the intersection member and slidable into an interior space of the first tube in a storage configuration wherein the second tube is generally coaxial with and substantially contained within the first marker; and a plurality of sharply-pointed pegs that pin the first tube to the mat in the golf-practice configuration;

wherein said plurality of pegs comprises a first peg having a first main body and a first shaft, and a second peg having a second main body and a second shaft, wherein, in the storage configuration, the first shaft extends into a bore in the second main body and the second shaft extends into a bore in the first main body for shielding the sharp point of the shafts and for connecting the first peg and the second peg in a peg assembly, and wherein the peg assembly is connected to the second tube.

16. The guide as in claim 15 wherein said peg assembly is connected the second tube by the second tube extending through the second main body and threadably connecting to a threaded post inside the main body of the first peg so that the first and second pegs are held end-to-end and generally coaxial with the second tube.

17. A golf practice guide that has a golf-practice configuration and a storage configuration, the guide comprising an elongated hollow member, an elongated insert member, and a connector;

wherein, in the golf-practice configuration, the connector receives both the hollow member and the insert member at 90 degrees to each other and so that the hollow member and insert member are moveable relative to each other while remaining at 90 degrees to each other; and wherein, in the storage configuration, the insert member is removed from the connector and slid and latched into an interior space of the hollow member;

the guide further comprising two elongated pegs, each with a pointed shaft;

wherein, in the golf-practice configuration, each peg is connected to a portion of the hollow member with its pointed shaft extending from the hollow member for insertion into a surface upon which a golfer practices; and wherein, in the storage configuration, the pegs are connected end-to-end into a peg assembly, with the pointed shaft of each of the pegs inserted into a main body of the other peg, and wherein the peg assembly is connected to, and coaxial with, the hollow member and with the insert member.

18. The guide as in claim 17, wherein the peg assembly is connected to the insert member by a portion of the peg assembly screwing into a threaded end of the insert member.

19. A golf stance guide for placement on a mat or ground, the guide comprising:

an elongated, horizontal, first marker for placement on an imaginary target line near a golfer's feet;

an elongated, horizontal second marker for pointing at a golf ball on the mat or ground;

an intersection member holding said first and second markers perpendicular to each other in a golf-practice configuration;

wherein said intersection member comprises a generally vertical sidewall surrounding and defining an interior bore extending through said intersection member from top to bottom of the intersection member, the sidewall having a first set of apertures that slidably receive the first marker, and having a second set of apertures, 90 degrees to said first set, that slidably receive the second marker, so that said first marker and said second marker pass through said first set of apertures and said second set of apertures respectively and cross at 90 degrees to each other in said interior bore;

said sidewall having a bottom perimeter edge comprising recessed portions that are on or above a horizontal plane through which the first marker extends and wherein the bottom perimeter edge further comprises downwardly-protruding portions that protrude down from the sidewall to be lower than said recessed portions, the downwardly-protruding portions being for contacting the mat or ground and reducing drag of the intersection member on the mat or ground.

20. A golf stance guide as in claim 19, wherein said first set of apertures are located in said downwardly-protruding portions, so that the first marker extends horizontally through said downwardly-protruding portions.

21. A golf stance guide as in claim 20, wherein said second set of apertures extend through the sidewall above the recessed portions of the bottom perimeter edge.

22. A golf stance guide as in claim 20, wherein said downwardly-protruding portions each have a curved outer edge.

23. A golf stance guide as in claim 20, wherein said intersection member is a cylindrical ring, wherein two of said downwardly-protruding portions are ears located 180 degrees apart on said sidewall.

24. A golf stance guide as in claim 20, wherein said intersection member is an oval member, wherein two of said downwardly-protruding portions are ears located 180 degrees apart on said sidewall.

25. A golf stance guide as in claim 20, wherein said intersection member is a diamond-shaped member having four sidewall portions, wherein two of said downwardly-protruding portions are ears protruding downward from two opposing corners of said diamond-shaped member.

26. A golf stance guide as in claim 20, wherein said intersection member is a rectangular member having four sidewall portions, wherein two of said downwardly-protruding portions are ears protruding downward from opposite sidewall portions of said diamond-shaped member.

* * * * *